United States Patent [19]

Pitrolo et al.

[11] 4,373,454

[45] Feb. 15, 1983

[54] OIL SHALE RETORTING AND COMBUSTION SYSTEM

[75] Inventors: Augustine A. Pitrolo, Fairmont; Joseph S. Mei, Morgantown, both of W. Va.; Jerry Y. Shang, Fairfax, Va.

[73] Assignee: The United States of America as represented by the Department of Energy, Washington, D.C.

[21] Appl. No.: 297,307

[22] Filed: Aug. 28, 1981

[51] Int. Cl.[3] ..... F23B 1/06; F23B 1/38; F23B 5/02; F23D 1/02

[52] U.S. Cl. ..... 110/347; 110/263; 122/4 D; 201/31; 201/41; 431/7

[58] Field of Search ..... 201/31, 41; 110/347, 110/345, 263; 431/10, 5, 7, 170; 432/15, 24; 60/39.46 S; 122/4 D

[56] References Cited

U.S. PATENT DOCUMENTS

| | | | |
|---|---|---|---|
| 3,356,075 | 12/1967 | Livingston | 110/347 |
| 3,454,383 | 7/1969 | Pirsh et al. | 201/31 |
| 3,976,558 | 8/1976 | Hall | 201/31 |
| 4,148,710 | 4/1979 | Burton | 201/31 |
| 4,238,922 | 12/1980 | Gitchel | 60/39.46 S |
| 4,250,820 | 2/1981 | Lautenschlager | 431/10 |
| 4,308,810 | 1/1982 | Taylor | 110/347 |

*Primary Examiner*—Bradley Garris

*Attorney, Agent, or Firm*—Earl L. Larcher; Stephen D. Hamel; Richard G. Besha

[57] ABSTRACT

The present invention is directed to the extraction of energy values from oil shale containing considerable concentrations of calcium carbonate in an efficient manner. The volatiles are separated from the oil shale in a retorting zone of a fluidized bed where the temperature and the concentration of oxygen are maintained at sufficiently low levels so that the volatiles are extracted from the oil shale with minimal combustion of the volatiles and with minimal calcination of the calcium carbonate. These gaseous volatiles and the calcium carbonate flow from the retorting zone into a freeboard combustion zone where the volatiles are burned in the presence of excess air. In this zone the calcination of the calcium carbonate occurs but at the expense of less BTU's than would be required by the calcination reaction in the event both the retorting and combustion steps took place simultaneously. The heat values in the products of combustion are satisfactorily recovered in a suitable heat exchange system.

2 Claims, 1 Drawing Figure

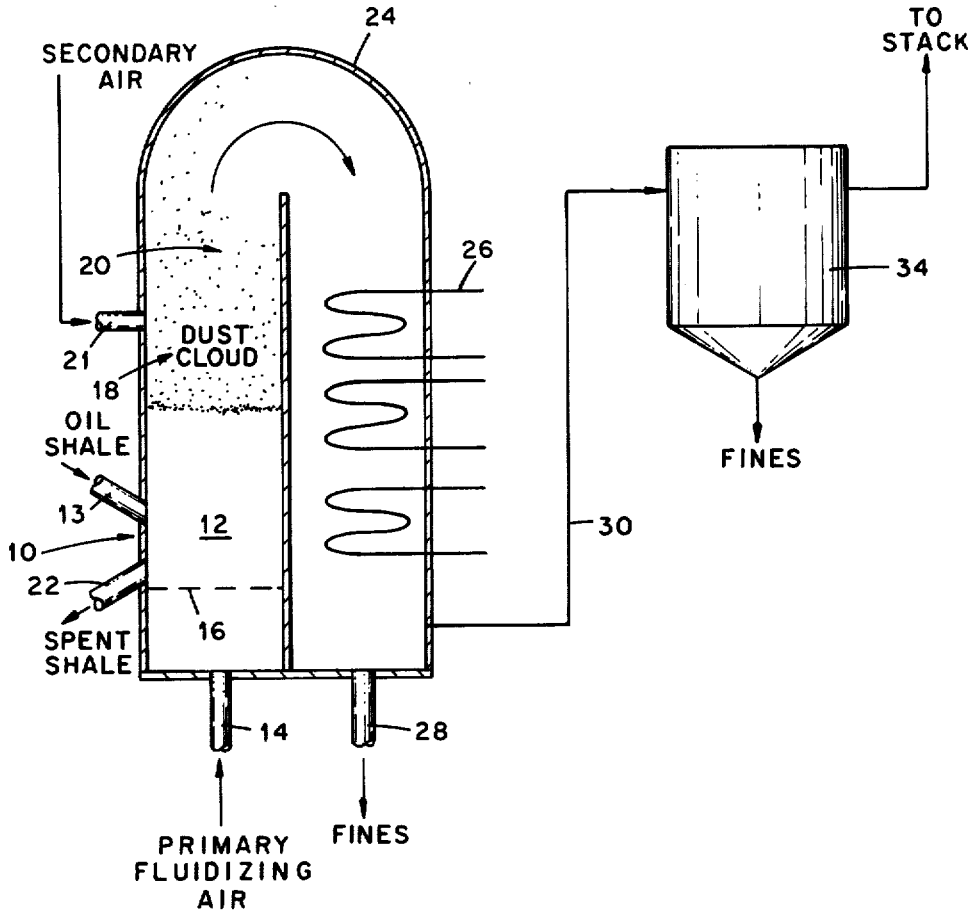
24
SECONDARY AIR
TO STACK
20
26
34
21
DUST CLOUD
18
OIL SHALE
FINES
13
12
30
10
22
16
SPENT SHALE
14
28
PRIMARY FLUIDIZING AIR
FINES

OIL SHALE RETORTING AND COMBUSTION SYSTEM

BACKGROUND OF THE INVENTION

The present invention relates generally to the extraction of energy values from oil shale and, more particularly, to a method for sequentially retorting and combusting oil shale containing calcium carbonate to effect efficient extraction of heat values from the oil shale.

With the increasing energy demands of the world and the decreasing reserves of conventionally recovered petroleum, alternative sources of energy are being extensively investigated as substitutes for energy extracted from petroleum. For example, oil shale contains a considerable concentration of volatile hydrocarbons which are recoverable from the shale by subjecting the shale to a sufficient temperature to drive off the volatile hydrocarbons contained therein. These volatile hydrocarbons may then be used in a combustion system as the primary fuel source. A significant problem which detracts from the efficiency of using oil shale for supplying volatile hydrocarbons for combustion purposes is that most oil shales contain a considerable concentration of calcium carbonate (limestone). Common of such oil shales are those found in vast quantities in areas such as Colorado, Israel, and Morocco. When oil shales containing considerable concentrations of calcium carbonate are burned in a direct combustion process, the calcium carbonate tends to undergo calcination which is an extensive heat-consuming reaction during which calcium carbonate is converted to lime. For each pound of calcium carbonate that is calcined as much as 600 to 700 BTU's of the available heat energy is consumed. This extensive heat consumption represents greater than about 30% of the total heat energy available in each pound of the Israeli oil shale and as much as about 24% of the heat energy available in each pound of the Colorado oil shale. Inasmuch as the limestone content in most oil shales such as mentioned above amounts to more than about 50% of the total oil shale composition, it becomes of increasing importance from the efficiency standpoint to effect the retorting or the separation of the hydrocarbons from the oil shale without simultaneously undergoing the calcination reaction to avoid the extensive loss of available heat energy suffered during concurrent calcination and combustion of the oil shale.

SUMMARY OF THE INVENTION

It is a primary aim or objective of the present invention to provide a fluidized bed system in which oil shale containing calcium carbonate is subjected to sequentially occurring (two-stage) retorting and combustion steps whereby volatile hydrocarbons representing maximum heat value may be extracted from the oil shale prior to the occurrence of any calcination reaction so as to extensively increase the efficiency of the energy extraction processes relating to oil shale. This aim or goal of the present invention is achieved by a method which comprises the steps of heating the oil shale in a first zone of a fluidized bed in the presence of a gaseous bed-fluidizing medium (air) having a sufficient oxygen concentration to provide a temperature adequate to thermally decompose the organic hydrocarbons in the oil shale into combustable volatiles and insufficient to provide the temperature necessary to effect substantial combustion of the extracted volatiles. The oxygen concentration is also insufficient to support combustion and the temperature is inadequate to effect the calcination of the calcium carbonate in the oil shale in the first zone. The volatiles released from the oil shale in the first zone and the particles of calcium carbonate flow into a second zone where they are contacted with excess air having a sufficient oxygen concentration to effect combustion of the combustable volatiles and the calcination of the calcium carbonate. The heat values released from the combustion are extracted from the resulting combustion gases by using conventional heat exchange mechanisms. By employing the staged retorting and combustion operation of the present invention, the heat energy previously utilized for the calcination during retorting is significantly reduced.

Other and further objects of the invention will be obvious upon an understanding of the illustrative method about to be described or will be indicated in the appended claims, and various advantages not referred to herein will occur to one skilled in the art upon employment of the invention in practice.

DESCRIPTION OF THE DRAWING

The FIGURE is a schematic representation of a fluidized bed reactor wherein staged retorting and combustion of oil shale containing calcium carbonate may be practiced in accordance with the teachings of the present invention.

A somewhat schematic view of a fluidized bed reactor has been chosen for the purpose of illustration and description of the subject method. The embodiment illustrated is not intended to be exhaustive or to limit the invention to the precise form of fluidized bed disclosed. It is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

With reference to the accompanying drawing, a vertically oriented fluidized bed reactor is generally shown at 10. Within the fluidized bed 10 there is a retorting or devolatilization zone 12 where oil shale, introduced through conduit 13 in particulate form in a size range of about 0 to 12 mesh, is subjected to decomposition or the thermal cracking of the kerogen or organic hydrocarbons in the oil shale to release combustable volatile hydrocarbons from the oil shale. To provide this retorting step, fluidizing air from a suitable source (not shown) is fed through conduit 14 into the retorting zone 12. A suitable grid 16 is disposed in the fluidized bed 10 below zone 12 for distributing the primary air flow into zone 12 for maintaining the oil shale particulates therein in a fluidized state. Within the retorting zone 12, the fluidized oil shale particulates are heated to a temperature sufficient to release the volatile hydrocarbons contained therein. In accordance with the present invention only minimal calcination of the available calcium carbonate occurs during the retorting step by maintaining the air utilized for the fluidizing of the bed at or slightly above stoichiometric. This lack of excess oxygen assures that the temperature within the retorting zone 12, will be maintained at a value less than that required for the calcination of the available calcium carbonate and also assures that only a small percent of the released olatile hydrocarbons are combusted in this retorting one.

The gaseous volatile hydrocarbons released from the il shale together with small particles of calcium carbonate and other gaseous and particulate material rise ertically from the retorting zone 12 in the form of a dust" cloud generally shown at 18. This cloud of gaseous and solid material rises into a freeboard combustion one generally shown at 20. Excess secondary air is ıtroduced through conduit 21 into the freeboard combustion zone 18 to effect the combustion of the volatile ydrocarbons released from the oil shale. The temperaıre of combustion in this zone of the fluidized bed is ufficient to effect calcination of the calcium carbonate.

By utilizing the staged retorting and combustion ones of the present invention, the heat energy needed or the calcination is considerably less than that previusly required if retorting, combustion and calcination f the oil shale took place in the same bed. In the freeoard combustion zone 18 the temperature and resience time are sufficient to provide almost instantaeous combustion of the combustibles so as to minimize he volume requirements for the combustion zone 18. The volume of excess air introduced into the combusion zone should be sufficient to provide an oxygen evel in the range of about 10 to 85 percent greater than toichiometric. Some heat values from the combustion f the volatiles in the freeboard zone 18 are radiated ıack down into the retorting zone 12 of the fluidized ıed so as to facilitate the extraction of the volatile hylrocarbons from the oil shale. The spent shale is renoved from the fluidized bed 10 by a suitable conduit as hown at 22.

Calcination takes place in the freeboard combustion one 18 at a temperature of about 1550° C. which is the ıormal operating temperature in a fluidized bed for naximum sulfur retention. At this temperature the calination reaction can achieve approximately 90% comletion. The high temperature combustion products, esulting from the combustion of the volatile hydrocarons released from the oil shale, vertically rise or flow rom the freeboard combustion zone 18 through suitable ıeat exchange means where the sensible heat in comustion products may be extracted for use in selected ıeat energy operated mechanisms. As shown in the drawing, the flow direction of the combustion products ising from the combustion zone 18 is reversed in conduit 24 and directed downwardly in a heat-exchange elationship with a plurality of heat exchangers generally shown at 26 wherein the sensible heat may be extracted from the combustion products for external use. The majority of the particulate material (fines) contained in the gases emanating released from the freeoard combustion zone 18 are discharged from the fluidized bed and heat-exchanger arrangement through conduit 28 located below the heat exchangers 26 while the remaining gases and fines are sent through a conduit 30 into a bag house or cyclone 34 for extraction of remaining solid material prior to the gases being discharged into the atmosphere through a suitable stack.

By directing the flow of combustion products downwardly through the "bent" conduit 24 the height of the reactor 10 may be significantly reduced over that which would be required without this redirection of flow. This bend in the combustion-products flow path forms a radiation arch to provide a temperature window (about 800° to 900° C.) for effecting reduction and relaxation of nitrogen oxides. Also, the downward flow of combustion products reduces or minimizes the size of an "ash crown" formed on horizontal surfaces of the heat exchangers 26.

The nitrogen compounds contained in the oil shale are converted into $NO_x$ compounds during retorting. In the oil shale retorting step, the volatile hydrocarbons tend to act as reducing compounds which react with the nitrogen oxide to form nitrogen and water or oxygen. The emission of $NO_x$ compounds remaining in the gases discharging from the stack into the atmosphere is well within EPA regulations. Sulfur dioxide ($SO_2$), on the other hand, is also present in the oil shale, since sulfur present in the oil shale is converted into sulfur dioxide. The sulfur dioxide is elutrified into fines in the freeboard combustion zone 18 where calcination of the elutriate limestone fines is occurring. The lime formed during the calcination reacts with the sulfur dioxide to form calcium sulphate for effectively and significantly reducing the level of sulfur dioxide emission in the stack gases. The quantity of sulfur dioxide discharging through the stack is considerably below the national standard of 1.2 pounds sulfur dioxide/$10^6$ BTU.

In order to provide a more facile understanding of the present invention, examples set forth below are directed to the staged retorting and combustion of oil shale obtained from Israel, Morocco, and Colorado in accordance with the present invention.

EXAMPLE I

The Israeli oil shale, which has a heat value of about 1914 BTU's per pound, in a particulate size of $-12+30$ mesh, was introduced into the retorting zone 12 of the fluidized bed 10. The bed temperature was 1300° F. with a velocity of the fluidizing air at 2.68 ft./sec and a bed depth of 6 inches (static). In the retorting zone, stoichoimetric air was utilized for fluidization and retorting purposes while in the freeboard combustion zone 44% excess air was used for combustion and calcination. The combustion efficiency was 99.86% based on solid analysis and the calcification of the calcium carbonate was 97.9% complete. The heat loss through calcination was 11.05% of the available heat energy in the oil shale as calculated by the heat loss over the total heat input times 100. The analyses of the flue gas of Examples I-III are set forth in the table following Example III below.

EXAMPLE II

Morocan shale of an Example II particle size of $12\times0$ mesh was introduced into the retorting zone of the fluidized bed and subjected to a bed temperature of about 1400° F. at a fluidization velocity of 2.84 ft./sec to provide a 6 inch bed depth. Stoichoimetric air was used in the retorting zone while 47.73% excess air was used in the freeboard combustion zone. The combustion efficiency of this shale which has a heat value of about 2378 BTU's per pound was 99.24% and the level of calcium carbonate calcination at 77.62%. The heat loss through calcination was only 3.5%.

EXAMPLE III

Colorado oil shale which has a heating value of about 2950 BTU's per pound, was introduced into the retorting zone of the fluidized bed in a particle size of $30\times0$ mesh. A bed temperature of 1550° F. was utilized with a fluidization velocity of 3.68 feet per second to provide a 6 inch bed depth. Stoichoimetric air was used in the retorting zone while 33.46% excess air was used in the freeboard combustion zone. The combustion efficiency for the Colorado oil shale was 99.54%, the calcination of the calcium carbonate was 93.78%, and the heat loss through calcination was 2.83%.

TABLE

| Flue Gas Analysis | Israeli Oil Shale | Moroccan Oil Shale | Colorado Oil Shale |
|---|---|---|---|
| $CO_2$ Vol. % | 14.00 | 12.50 | 17.60 |
| CO Vol. % | 0.02 | 0.05 | 0.07 |
| $O_2$ Vol. % | 6.63 | 7.00 | 5.50 |
| $SO_2$, ppm | 100 | 100 | 100 |
| $SO_2$, lb./$10^6$ Btu | 0.26 | 0.27 | 0.16 |
| $NO/NO_x$, ppm | 772 | 800 | 200 |
| $NO_x$ lb./$10^6$ Btu | 1.0 | 1.09 | 0.16 |
| THC, ppm | 20 | 100 | 4000 |

It will be seen that the present invention provides a relatively simple and highly efficient method for recovering heat values from oil shale containing considerable concentrations of limestone.

What is claimed is:

1. A method for extracting energy values from oil shale having substantial concentrations of calcium carbonate therein, comprising the steps of heating particulate oil shale in a retorting zone in a bed reactor, fluidizing the contents in said zone with air having an oxygen content of about stoichiometric and sufficient to provide for the heating of oil shale to a temperature adequate to thermally decompose the organic hydrocarbons therein and insufficient to provide a temperature adequate to effect substantial combustion of the hydrocarbons extracted from the oil shale or substantial calcination of the calcium carbonate, conducting the extracted hydrocarbons and the calcium carbonate in an upward direction into a freeboard combustion zone, contacting the contents in said freeboard combustion zone with excess air having an oxygen level in the range of about 10 to 85 percent greater than stoichiometric to provide a temperature sufficient to effect the combustion of said volatiles and the calcination of said calcium carbonate in said combustion zone, thereafter extracting sensible heat from the resulting combustion products.

2. The method claimed in claim 1, including the additional step of conducting the flow of the products of combustion emanating from the combustion zone in a direction opposite to the upward direction of flow of the extracted hydrocarbons and calcium carbonate being conducted from the retorting zone into the combustion zone to provide a radiation arch for controlling nitrogen oxides emission and for reducing ash crown build up on horizontal surfaces in the flow path of the products of combustion.

* * * * *